US006793001B2

(12) United States Patent
Sakou et al.

(10) Patent No.: US 6,793,001 B2
(45) Date of Patent: Sep. 21, 2004

(54) CASTING SAND BLOWING DEVICE FOR MOLDING MACHINES

(75) Inventors: Koji Sakou, Toyokawa (JP); Fumikazu Shiose, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 131 days.

(21) Appl. No.: 09/979,144

(22) PCT Filed: Mar. 19, 2001

(86) PCT No.: PCT/JP01/02149

§ 371 (c)(1),
(2), (4) Date: Nov. 20, 2001

(87) PCT Pub. No.: WO01/70433

PCT Pub. Date: Sep. 27, 2001

(65) Prior Publication Data

US 2002/0157804 A1 Oct. 31, 2002

(30) Foreign Application Priority Data

Mar. 21, 2000 (JP) ..... 2000-077381
Mar. 24, 2000 (JP) ..... 2000-083083
May 17, 2000 (JP) ..... 2000-144252

(51) Int. Cl.[7] ..... B22C 15/22

(52) U.S. Cl. ..... 164/200; 164/169; 164/201; 164/202; 164/173; 425/138; 425/450.1

(58) Field of Search ..... 164/200, 169, 164/37, 201, 202, 173; 425/138, 450.1

(56) References Cited

U.S. PATENT DOCUMENTS 4,035,157 A * 7/1977 Riester ..... 422/168
4,437,507 A * 3/1984 Seeley ..... 164/173
5,062,470 A * 11/1991 Rikker ..... 164/457
5,148,852 A * 9/1992 Oishi ..... 164/169
5,338,171 A * 8/1994 Hayakawa et al. ..... 425/138

FOREIGN PATENT DOCUMENTS

JP 55-156640 12/1980

* cited by examiner

*Primary Examiner*—Kiley Stoner
*Assistant Examiner*—I.-H. Lin
(74) *Attorney, Agent, or Firm*—Finnegan, Henderson, Farabow, Garrett & Dunner L.L.P.

(57) ABSTRACT

A sand-blowing apparatus for a molding machine having a sand-storing tank for storing foundry sand disposed so as to be movable vertically and having an opening in an upper part of the sand-storing tank for supplying sand thereto, a nozzle in a bottom part of the sand-storing tank, a chamber in a central part of the sand-storing tank, and an exhaust valve that communicates with the chamber, a compressed air tank for storing compressed air that is movable vertically located above the sand-storing tank, and having an opening in a bottom part of the compressed air tank for blowing compressed air, a device for moving the compressed air tank toward and away from the sand-storing tank, a valve for controlling the opening and closing of the opening in the bottom part of the compressed air tank, a piston rod connected to said valve that passes through an upper part of the compressed air tank, and a device for raising and lowering the piston rod to thereby open and close the valve, wherein when the compressed air tank is lowered and abuts the sand-storing tank, the opening in the upper part of the sand-storing tank communicates with the opening in the bottom part of the compressed air tank so that when the valve in the compressed air tank is opened, foundry sand is blown through the nozzle in the sand-storing tank by the compressed air in the compressed air tank.

4 Claims, 6 Drawing Sheets

CASTING SAND BLOWING DEVICE FOR MOLDING MACHINES

TECHNICAL FIELD

This invention relates to the improvement in an apparatus for blowing foundry sand into a molding machine for molding a core. It especially relates to molding machines wherein vertically divided metal molds for shell sand or cold-box-process core sand are used, and wherein the position at which sand is blown into molds is changeably constituted. It also relates to a blow squeeze apparatus for a molding machine to which an additional set of equipment is added for treating gases with a smell that are generated when shell sand is fired to prepare dry sand.

BACKGROUND OF THE INVENTION

As shown in general in FIG. 1, the conventional blow squeeze apparatus is constituted such that a tank 21 for storing sand, a connector 23, an air-supply/exhaust valve 25, and an air tank 27 are connected via a piston rod 22 and conduits 24,26. In the thus-constituted conventional blow-squeeze apparatus, since the distance between the air tank 27 and sand tank 21 is long, the entire apparatus is bulky, a large loss of pressure in the compressed air exists therebetween, and a large-volume air tank is needed to provide a needed amount of compressed air.

The conventional blow squeeze apparatus, as is shown in Japanese Patent Early-publication No. 51-43973, is constituted such that the entire stand frame on which molding machine mechanisms are installed can be slid together. Therefore, the conventional blow squeeze apparatus has disadvantages in that the sliding portion has complex structures, a large scale of equipment is needed, and a number of processes are needed to adjust the position at which sand is blown.

The conventional shell machine equipped with an apparatus for treating gases with a smell is generally constituted such that a hood is fixed just above each of a plurality of the machines, and that gases with a smell which are generated from each machine are transported via a guide tube or a suction pipe to a separate means disposed outside the factory for treating them. Since the means for treating gases with a smell must carry a large volume of the air in addition to the gases from the machines over a long distance, the loss of pressure during the transportation becomes large and the apparatus for treating gases with a smell, including the mechanism for absorbing them, becomes large and costly.

DISCLOSURE OF INVENTION

This invention has been made considering the above-mentioned problems. An object of this invention is to provide a molding machine having a simple structure, wherein the position in a metal mold at which foundry sand is blown thereinto can be easily changed.

Another object of this invention is to provide a blow-squeeze molding machine. It has a means for treating gases with a smell used for a shell machine, which is equipped with a compact, cheap, and separate hood, and wherein the loss of pressure during the transportation of the gases can be kept small.

To achieve the above purposes the apparatus according to an embodiment of this invention for blowing foundry sand into molds for a molding machine comprises a tank disposed movably up and down for storing foundry sand, and having an opening that passes through the upper part of the tank for supplying the sand, a nozzle that passes through the bottom part of the tank, an empty chamber that occupies the central part of the tank, and an exhaust valve placed on the empty chamber; a tank for storing compressed air disposed just above a mold movably up and down above the sand-storing tank, and having an opening that passes through the bottom part of the compressed air tank for blowing compressed air, wherein when the sand tank is lowered and abuts the sand tank, the sand-supplying opening communicating with the compressed air-blowing opening so that the foundry sand is blown through the nozzle by the compressed air from the compressed air-blowing opening; and means disposed in the compressed air tank for opening and closing the compressed air-blowing opening.

The thus-constituted blow-squeeze apparatus can supply the compressed air stored in the compressed air tank into the sand tank by opening the opening and closing means after making the compressed-air opening abut the sand-supplying opening.

The apparatus according to an embodiment of this invention for adapting a position at which foundry sand is blown into metal molds in a molding machine comprises a stationary member 35 for adjustably fixing the position of a first vertically-divided mold to adapt the position of the divided mold to the position of the blow-squeeze nozzle and a sliding member 36 for disposing a second vertically-divided mold such that the second vertically-divided mold that corresponds to the first vertically-divided mold is slid to be aligned with the first vertically-divided mold.

The thus-constituted apparatus for adapting the blow-squeeze position can easily move left and right and adjust a metal mold-installing member that installs the stationary and divided piece of the metal molds such that the blow-squeeze position of the metal molds corresponds to the sand-discharging opening of the blow-squeeze apparatus, namely, the sand-discharging nozzle.

The apparatus according to an embodiment of this invention for treating gases with a smell used for a shell machine comprises a hood for covering almost the entire shell machine, means disposed adjacent to the hood for treating the gases with a smell, a mechanism for absorbing the gases in the hood and for feeding them to the gas-treating means, and a guide tube connected to the gas-absorbing mechanism for guiding the gases fed from the gas-absorbing mechanism to the gas-treating means.

In the thus-constituted apparatus for treating gases with a smell, the gases with a smell generated in the shell machine are passed through the hood and the guide tube by the absorbing operation of the gas-absorbing mechanism, and then they are sent to the gas-treating means so that they are burnt or treated to be deodorized.

BRIEF DESCRIPTIONS OF DRAWINGS

PREFERRED EMBODIMENTS OF INVENTION

Figure 2:
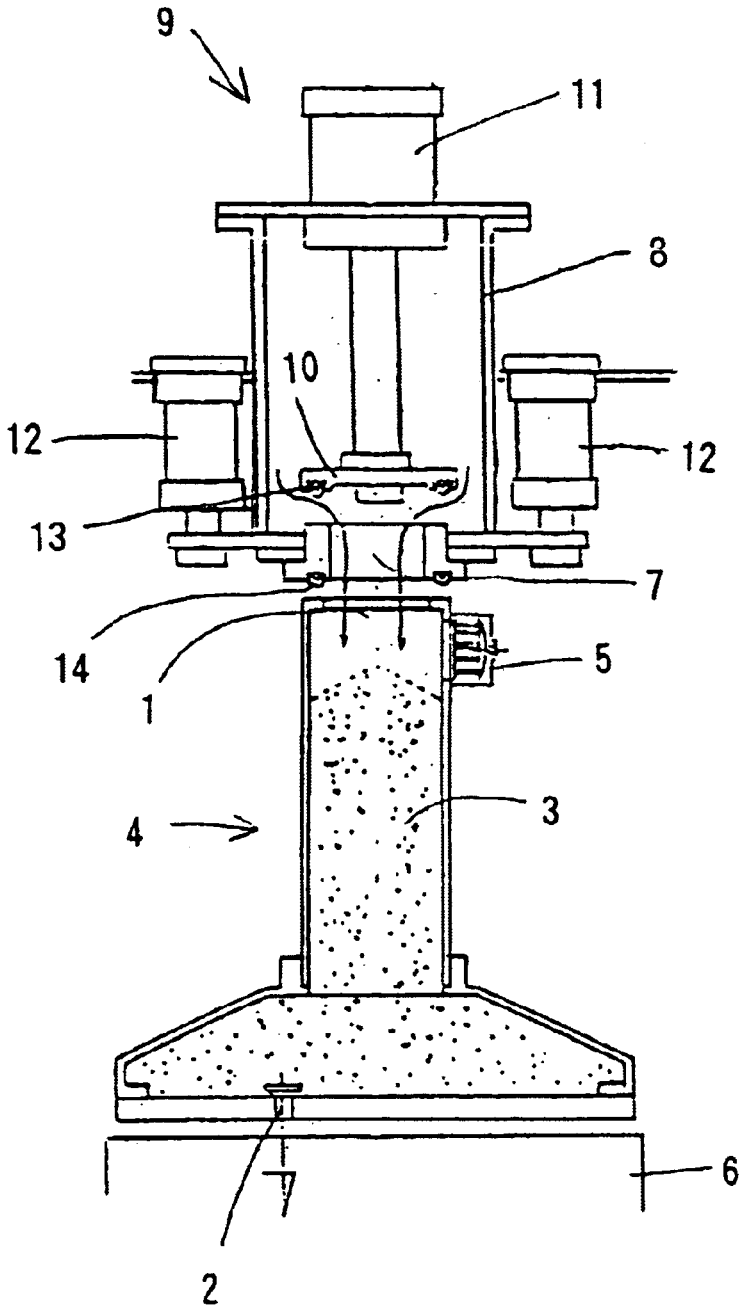
FIG. 2 is an elevation to show an embodiment of the blow-squeeze apparatus of this invention used for a molding machine.

We now explain a first embodiment of this invention by referring to FIG. 2. The blow-squeeze apparatus comprises a sand tank 4 for storing foundry sand, a compressed-air tank 8 disposed above the sand tank for storing compressed pressure, and means 9 for opening and closing an opening 7 through which foundry sand is blown thereinto.

The horizontally and vertically movable sand tank 4 comprises an empty chamber 3. A sand-supplying opening 1 and a sand-discharging nozzle 2 are disposed at the upper end and lower end of the sand tank 4, respectively. An exhaust valve 5 for discharging the residual compressed air in the tank is disposed in the upper part of the sand tank 4. The position of the sand-discharging nozzle 2 is made to correspond to a blow-squeeze position, namely, a position at which sand is blown into metal molds 6 (not shown) disposed just under the sand tank 4 for molding a core (as detailed below).

The compressed-air tank 8, having a discharging opening 7 disposed in the bottom thereof for discharging compressed air, is disposed above the sand tank 4 and is movable vertically by the expansion and contraction movements of downward-moving cylinders 12,12 disposed at both sides of the tank 8. The discharging opening 7 of the compressed-air tank 8 is connected to the sand-supplying opening 1 when the tank 8 is lowered to discharge sand by the compressed air held temporarily therein. An opening-and-closing means 9, which passes through the ceiling plate of the tank 8, and which expands towards and upwards therein, comprises a piston rod 11, on the lower end of which a valve 10 is fixed.

Thus, in the blow-squeeze apparatus, the compressed air-discharging opening 7 of the compressed-air tank 8 is lowered by the expansion movement of the cylinders 12,12 until it abuts the core sand-supplying opening 1, and then the discharging opening 7 is opened by the operation of the valve 10 that is raised by the contraction movement of the cylinder 11 so that the compressed air in the compressed-air tank is sent into the sand tank 4, and so that the core sand is simultaneously discharged into the metal molds 6. After the discharge of the sand has been completed, and after the discharge opening 7 has been closed by lowering the valve 10 through the expansion movement of the cylinder 11, the residual compressed air in the sand tank is discharged by operating the exhaust valve 5, to thus complete a blow squeeze cycle.

Figure 3:
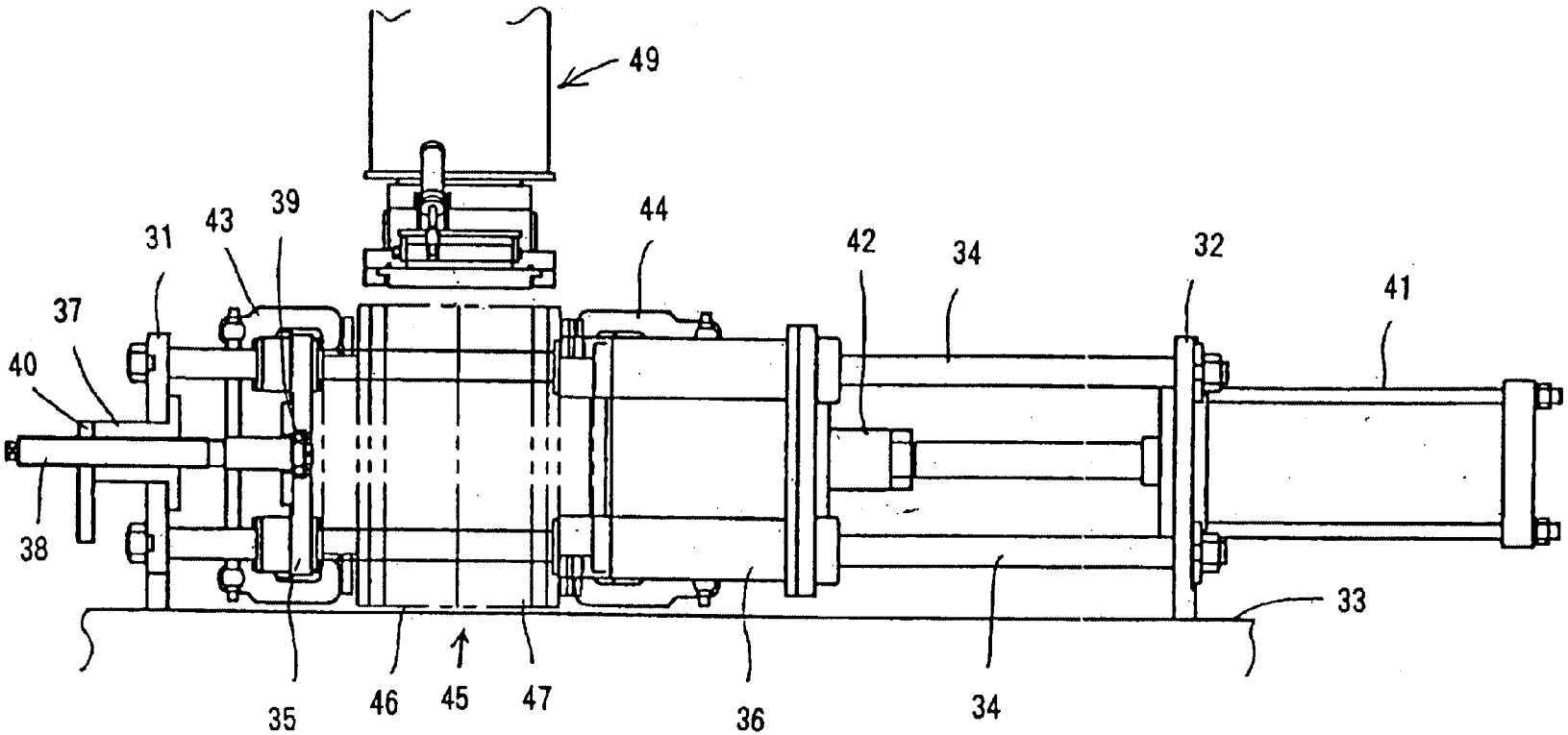
FIG. 3 is a front view to show an embodiment of the blow-squeeze molding machine of this invention.
Figure 4:
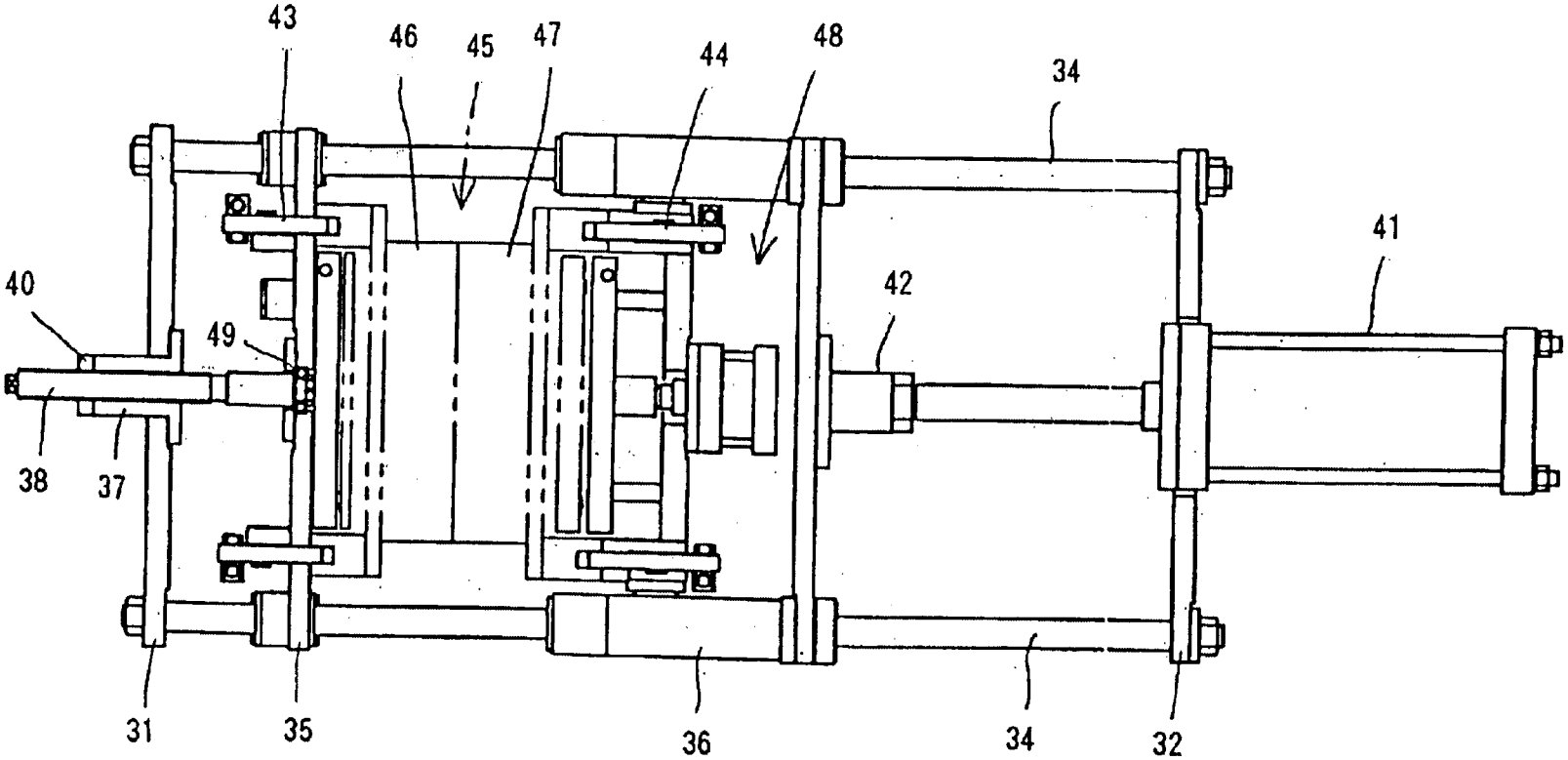
FIG. 4 is a plan of the blow-squeeze molding machine of FIG. 3.

Referring to FIGS. 3 and 4, now we explain an embodiment of the apparatus for adapting a sand-squeeze position used for the molding machine according to this invention. The adapting apparatus is comprised such that a movable piece of metal mold 47 is movably installed against a piece of stationary metal mold 46 fixed in the metal molds 45, which consist of two pieces vertically divided in half.

As shown in FIGS. 3 and 4, two rectangular die plates 31, 32 are mounted on the machine stand of the blow-squeeze molding machine so that they are distanced by a fixed interval in the left and right directions viewed from the front, and so that four tie bars 34, 34 are bridged between their four corners. A stationary installing member 35, on which the stationary metal mold 46 is to be mounted, is installed a little to the left, and a movable installing member 36, on which the movable mold 47 is to be mounted, is installed a little to the right, so that both members can slide respectively.

On the center of the left die plate 31 a special nut 37 is installed such that it extends in the left and right directions so that it passes through the plate 31. A special bolt 38 is screwed into the nut 37 so that it passes therethrough. The right end of the special bolt 38 is pivotally connected onto the back surface of the stationary installing member 35 via a ball bearing 39. The stationary installing member 35 is installed such that it is adjustably movable left and right by the clockwise/counterclockwise rotation of the special bolt 38. A lock nut 40 is screwed onto the special bolt 38 at the left end of the special nut 37. A cylinder 41, extending left and right, is installed in the central part of the right die plate 32 passing therethrough. The end of the rod of the cylinder 41 is connected via a joint member 42 onto the rear surface of the movable installing member 36. Conventional clamping mechanisms 43 and 44 are mounted on the stationary installing member 35 and movable installing member 36, respectively.

In the blow-squeeze positioning apparatus constituted thusly, the movable installing member 36 is moved right by the contraction operation of the cylinder 41, and then the stationary piece 46 and movable piece 47 of the metal molds 45 are mounted on the stationary installing member 35 and movable installing member 36, respectively. At this point the blow squeeze position of the metal molds 45 is adjusted such that the special bolt 38 is turned clockwise or counterclockwise to move the stationary installing member 35 right or left so that the blow-squeeze position coincides with the nozzle (not shown) of the blow-squeeze apparatus 49.

Figure 5:
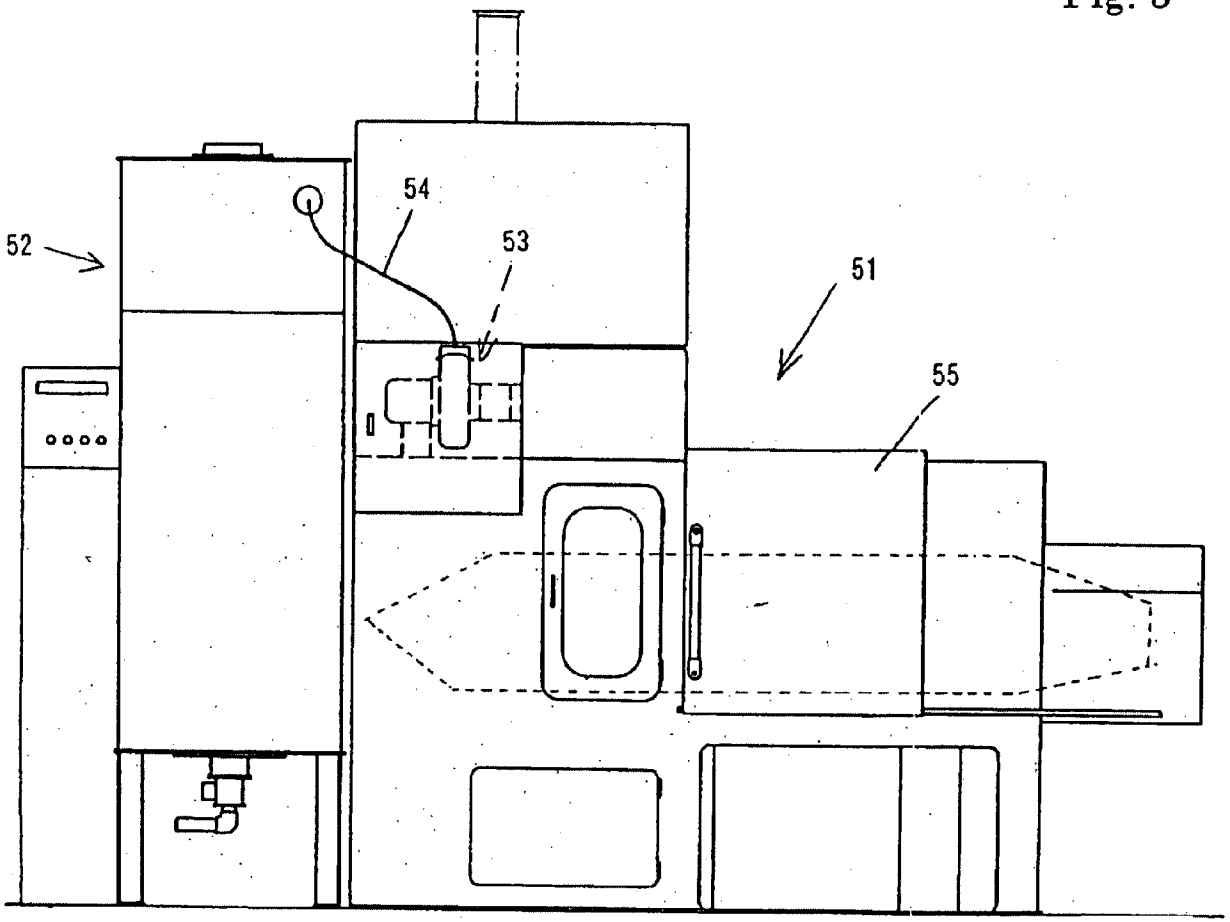
FIG. 5 is a front view to show an embodiment of the apparatus of this invention for treating gases with a smell.
Figure 6:
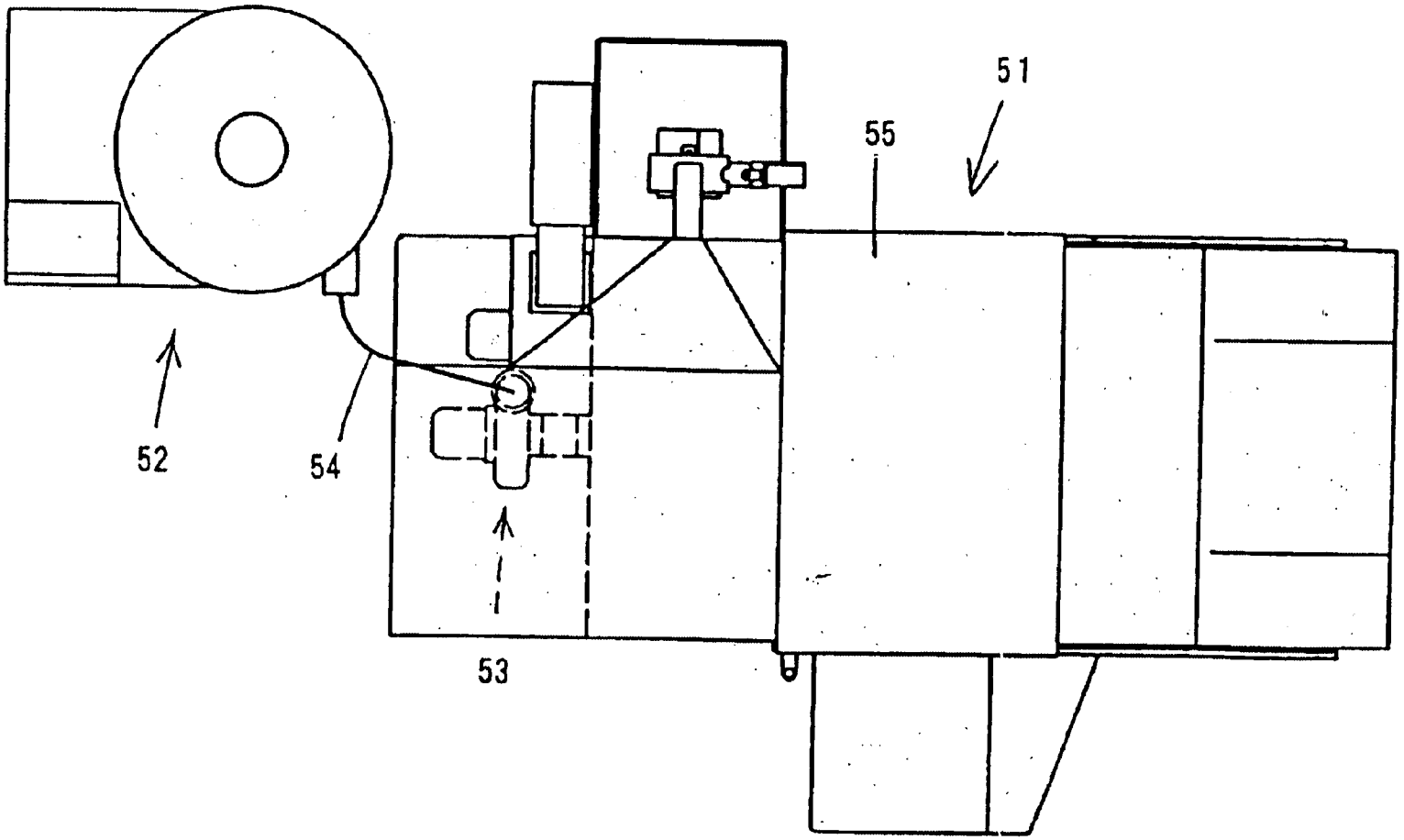
FIG. 6 is a plan of the apparatus of FIG. 5 for treating gases with a smell.

Referring to FIGS. 5 and 6, now we explain an embodiment of the apparatus of this invention for treating gases with a smell. The gas-treating apparatus comprises a hood 51 that surrounds the entire molding machine, of which the outline is indicated by a dotted line as shown in FIG. 5 and means 52 disposed adjacent thereto for treating gases with a smell.

A blower 53, which absorbs gases with a smell within the hood 51 and sends them into the gas treating means 52, is installed in the hood 51. The blower 53 is placed on the outside of the hood 51, which is situated above the metal mold of the shell machine. The gases with a smell to be absorbed are sent by the blower 53 via a guide tube 54 into the gas-treating means 52. In a part within the hood 51 that corresponds to a position of the shell machine where the metal mold is mounted, a sliding door 55 is installed so as to confirm that the sand-discharging nozzle 2 mentioned above coincides with the blow-squeeze position of the metal mold of the core molding machine. The gas treating means 52 comprises a portion where gases with a smell are burnt and a heat-exchange part wherein the temperature of gases with a smell is raised by using the heat generated by burning them.

Thus, in the gas-treating apparatus gases with a smell generated by the molding machine are absorbed into the blower 53, passed through the hood 51 and guide tube 54, and then finally burnt in the gas-treating means 52.

EFFECTS OF INVENTION

Figure 1:
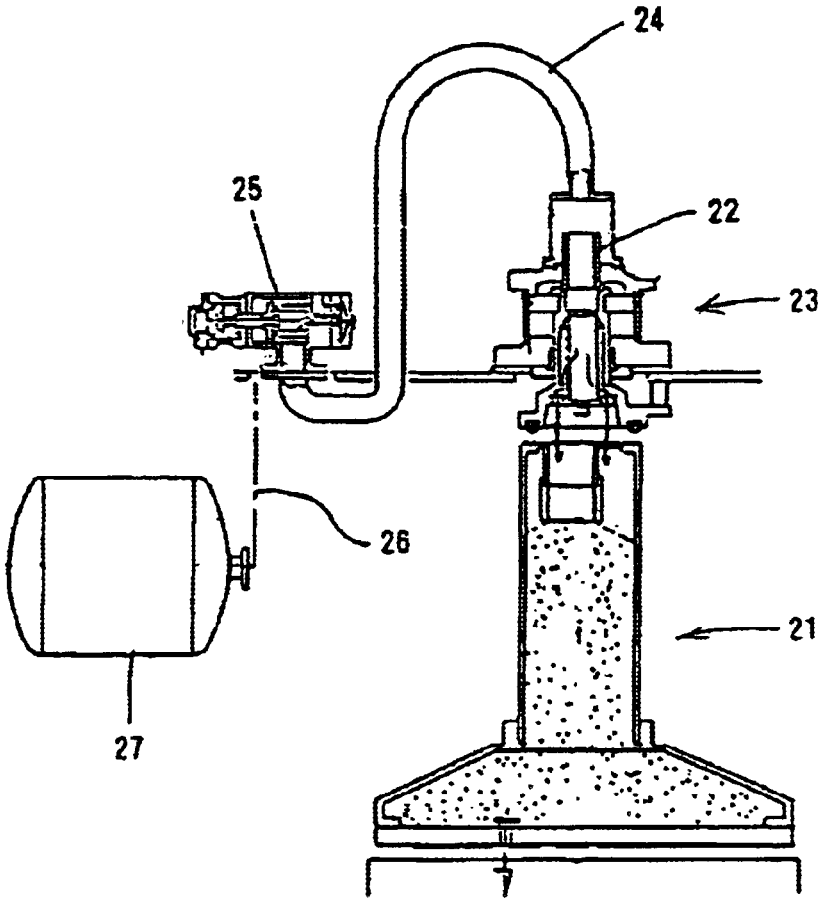
Fig. 1 Prior Art
FIG. 1 is an elevation to show the cross section of the conventional blow-squeeze apparatus.

As is clear from the above explanations, the inventions of this application have outstanding practical effects in various aspects in that the blow squeeze apparatus of this invention, compared with the conventional apparatus as shown in FIG. 1, can reduce the loss of pressure in the compressed air conveyed from the air tank to the sand tank; the blow-squeeze positioning apparatus of this invention used for a molding machine has a simple structure, and can easily and correctly adapt and adjust the position at which the blow squeeze is carried out; and the apparatus of this invention for treating gases with a smell, as compared with the conventional shell machine, can be equipped with compact and cheap gas-treating means and gas-absorbing means, and can reduce the loss of pressure in transporting gases with a smell by using the unique guide tube.

What we claim is:

1. A sand-blowing apparatus for a molding machine comprising, a sand-storing tank for storing foundry sand disposed so as to be movable vertically and having an opening in an upper part of the sand-storing tank for supplying sand thereto, a nozzle in a bottom part of the sand-storing tank, a chamber in a central part of the sand-storing tank, and an exhaust valve that communicates with the chamber, a compressed air tank for storing compressed air that is movable vertically located above the sand-storing tank, and having an opening in a bottom part of the compressed air tank for blowing compressed air, means for moving the compressed air tank toward and away from the sand-storing tank, a valve for controlling the opening and closing of the opening in the bottom part of the compressed air tank, a piston rod connected to said valve that passes through an upper part of the compressed air tank, and means for raising and lowering said piston rod to thereby open and close said valve, wherein when the compressed air tank is lowered and abuts the sand-storing tank, the opening in the upper part of the sand-storing tank communicates with the opening in the bottom part of the compressed air tank so that when the valve in the compressed air tank is opened, foundry sand is blown through the nozzle in the sand-storing tank by the compressed air in the compressed air tank.

2. The apparatus of claim 1, wherein said foundry sand is shell sand or cold-box sand used for core metal molds.

3. An apparatus for adapting a position at which foundry sand is blow-squeezed into vertically divided metal molds comprising, a sand-storing tank for storing foundry sand disposed so as to be movable vertically and having an opening in an upper part of the sand-storing tank for supply sand thereto, a nozzle in a bottom part of the sand-storing tank, a chamber in a central part of the sand-storing tank, and an exhaust valve that communicates with the chamber, a compressed air tank for storing compressed air that is movable vertically located above the sand-storing tank, and having an opening in a bottom part of the compressed air tank for blowing compressed air, means for moving the compressed air tank toward and away from the sand-storing tank, a valve for controlling the opening and closing of the opening in the bottom part of the compressed air tank, a piston rod connected to said valve that passes through an upper part of the compressed air tank, means for raising and lowering said piston rod to thereby open and close said valve, a pair of vertically divided metal molds that-when placed together from a divided mold, a stationary member for adjustably fixing the position of a first vertically-divided mold to adapt a position of the divided mold to a position of the nozzle of the sand-storing tank, and a sliding member for locating a second vertically-divided mold such that the second vertically-divided mold can be aligned with the first vertically-divided mold, wherein when the compressed air tank is lowered and abuts the sand-storing tank, the opening in the upper part of the sand-storing tank communicates with the opening in the bottom part of the compressed air tank so that when the valve in the compressed air tank is opened, foundry sand is blown through the nozzle in the sand-storing tank by the compressed air in the compressed air tank and into the divided mold.

4. The apparatus of claim 3, including:

a pair of die plates mounted on a stationary surface, a pair of tie bars connected between said die plates, clamping means for holding each vertically-divided mold that slide along said tie bars so that each of said first and second vertically-divided molds can be slid horizontally toward and away from each other, wherein said stationary member for adjustably fixing the position of the first vertically-divided mold includes a bolt that is threadably screwed at one end into a central part of a first die plate and extends parallel to the tie bars, a ball bearing that pivotally connects the first-vertically divided mold to an opposite end of the bolt, and a lock nut for fixing the bolt in place in the first die, and wherein said sliding member for locating the second vertically-divided mold includes a hydraulic cylinder mounted on a second die plate and having a cylinder rod that passes through a center of the second die plate and extends parallel to the tie bars, an outer end of the rod of the cylinder being connected to the second vertically-divided mold.

* * * * *

UNITED STATES PATENT AND TRADEMARK OFFICE

CERTIFICATE OF CORRECTION

PATENT NO. : 6,793,001 B2
DATED : September 21, 2004
INVENTOR(S) : Koji Sakou et al.

It is certified that error appears in the above-identified patent and that said Letters Patent is hereby corrected as shown below:

Column 5,
Line 44, “supply” should read -- supplying --.

Column 6,
Line 10, “vertically divided” should read -- vertically-divided --.
Line 10, “that-when” should read -- that when --.
Line 11, “from” should read -- form --.
Lines 41-42, “first-vertically divided” should read -- first vertically-divided --.

Signed and Sealed this

Eighth Day of March, 2005

JON W. DUDAS
*Director of the United States Patent and Trademark Office*